US010234131B2

(12) United States Patent
Lee

(10) Patent No.: US 10,234,131 B2
(45) Date of Patent: Mar. 19, 2019

(54) BOTTLE HOLDING APPARATUS HAVING REMOVABLE LED LIGHT SOURCE

(71) Applicant: You Taek Lee, Seoul (KR)

(72) Inventor: You Taek Lee, Seoul (KR)

( * ) Notice: Subject to any disclaimer, the term of this patent is extended or adjusted under 35 U.S.C. 154(b) by 0 days.

(21) Appl. No.: 15/713,632

(22) Filed: Sep. 23, 2017

(65) Prior Publication Data

US 2018/0010785 A1 Jan. 11, 2018

Related U.S. Application Data

(63) Continuation of application No. PCT/KR2015/008113, filed on Aug. 3, 2015.

(30) Foreign Application Priority Data

Mar. 23, 2015 (KR) ..... 10-2015-0040377

(51) Int. Cl.

| | |
|---|---|
| ***F21V 3/00*** | (2015.01) |
| ***F21V 33/00*** | (2006.01) |
| ***A47G 23/02*** | (2006.01) |
| ***F21V 15/01*** | (2006.01) |
| ***F21V 23/02*** | (2006.01) |
| ***F21V 23/04*** | (2006.01) |

(Continued)

(52) U.S. Cl.

CPC ..... *F21V 33/0036* (2013.01); *A47G 23/0241* (2013.01); *A47G 23/0309* (2013.01); *F21V 3/00* (2013.01); *F21V 15/01* (2013.01); *F21V 23/023* (2013.01); *F21V 23/04* (2013.01); *A47G 2200/08* (2013.01); *F21Y 2115/10* (2016.08)

(58) Field of Classification Search

CPC ..... F21V 33/0036; F21V 3/00; F21V 15/01; F21V 23/023; F21V 23/04; A47G 23/0241; A47G 2200/08; F21Y 2115/10

See application file for complete search history.

(56) References Cited

U.S. PATENT DOCUMENTS 4,336,574 A * 6/1982 Goodman ..... A47G 23/0309 248/346.11
5,307,250 A * 4/1994 Pearson ..... A47G 23/0309 200/85 R (Continued)

FOREIGN PATENT DOCUMENTS

KR 200314005 B1 5/2003
KR 200438241 B1 2/2008

OTHER PUBLICATIONS

International Search Report of PCT/KR2015/008113, dated Nov. 23, 2015, English Translation.

*Primary Examiner* — Anh T Mai
*Assistant Examiner* — Fatima N Farokhrooz
(74) *Attorney, Agent, or Firm* — STIP Law Group, LLC

(57) ABSTRACT

Proposed is a bottle holding apparatus having a removable LED light source. The bottling apparatus includes a bottle holder body and a lighting device module. The bottle holder body is structured to accommodate a lower portion of a bottle. The lighting device module is removably fitted in the bottle holder body and is removable from underside of the bottle holder body. Light generated by an LED light source of the lighting device module is illuminated through the lower portion of the bottle accommodated in the bottle holder body, thereby providing visual lighting effects and creating a romantic atmosphere suitable for drinking alcohol.

6 Claims, 6 Drawing Sheets

(51) Int. Cl.
*A47G 23/03* (2006.01)
*F21Y 115/10* (2016.01)

(56) References Cited

U.S. PATENT DOCUMENTS

| | | | | |
|---|---|---|---|---|
| 6,416,198 | B1 * | 7/2002 | Vanderschuit | A47G 19/2222 362/101 |
| 6,966,666 | B2 * | 11/2005 | Liu | F21V 33/0028 362/101 |
| 2003/0076281 | A1 * | 4/2003 | Morgan | F24C 7/004 345/44 |
| 2004/0202751 | A1 * | 10/2004 | McKay | A23G 3/0097 426/112 |
| 2007/0171627 | A1 * | 7/2007 | Hsu | A47G 19/2227 362/101 |
| 2009/0166378 | A1 * | 7/2009 | Stilley | B05B 1/00 222/39 |
| 2012/0176782 | A1 * | 7/2012 | VanderSchuit | F21S 10/00 362/184 |
| 2014/0268866 | A1 * | 9/2014 | Yang | G09F 19/00 362/605 |
| 2014/0300273 | A1 * | 10/2014 | LeBrun | G09F 23/06 315/76 |

* cited by examiner

[Fig. 1]
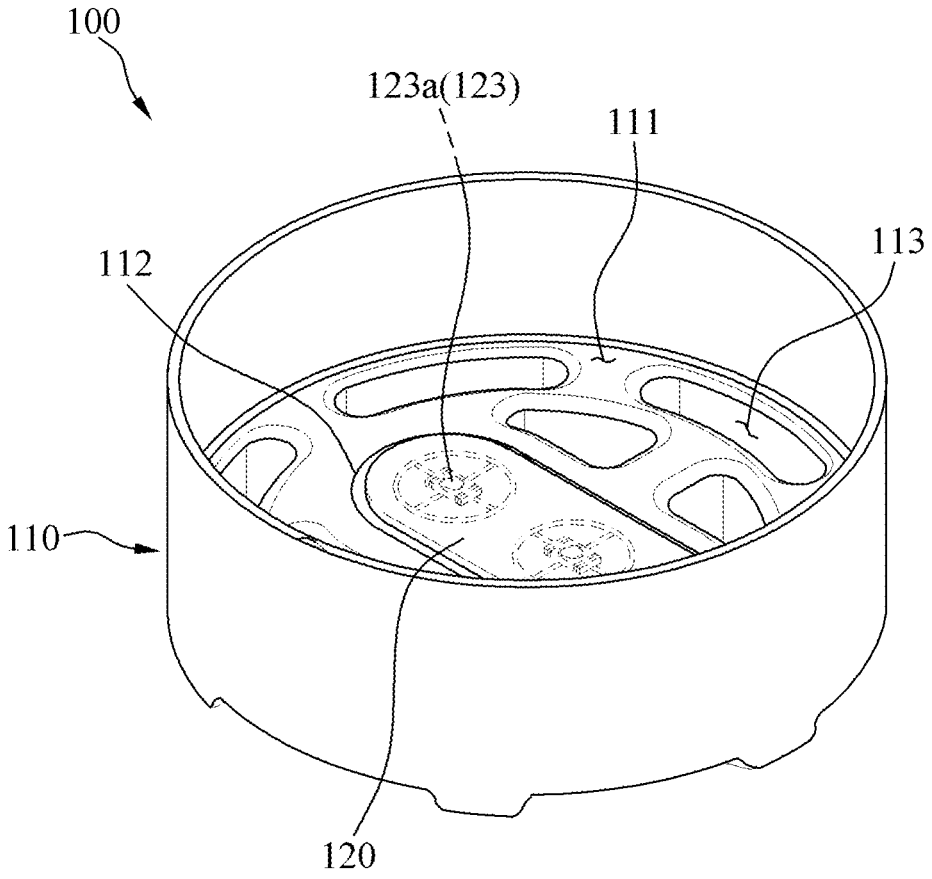

[Fig. 2]
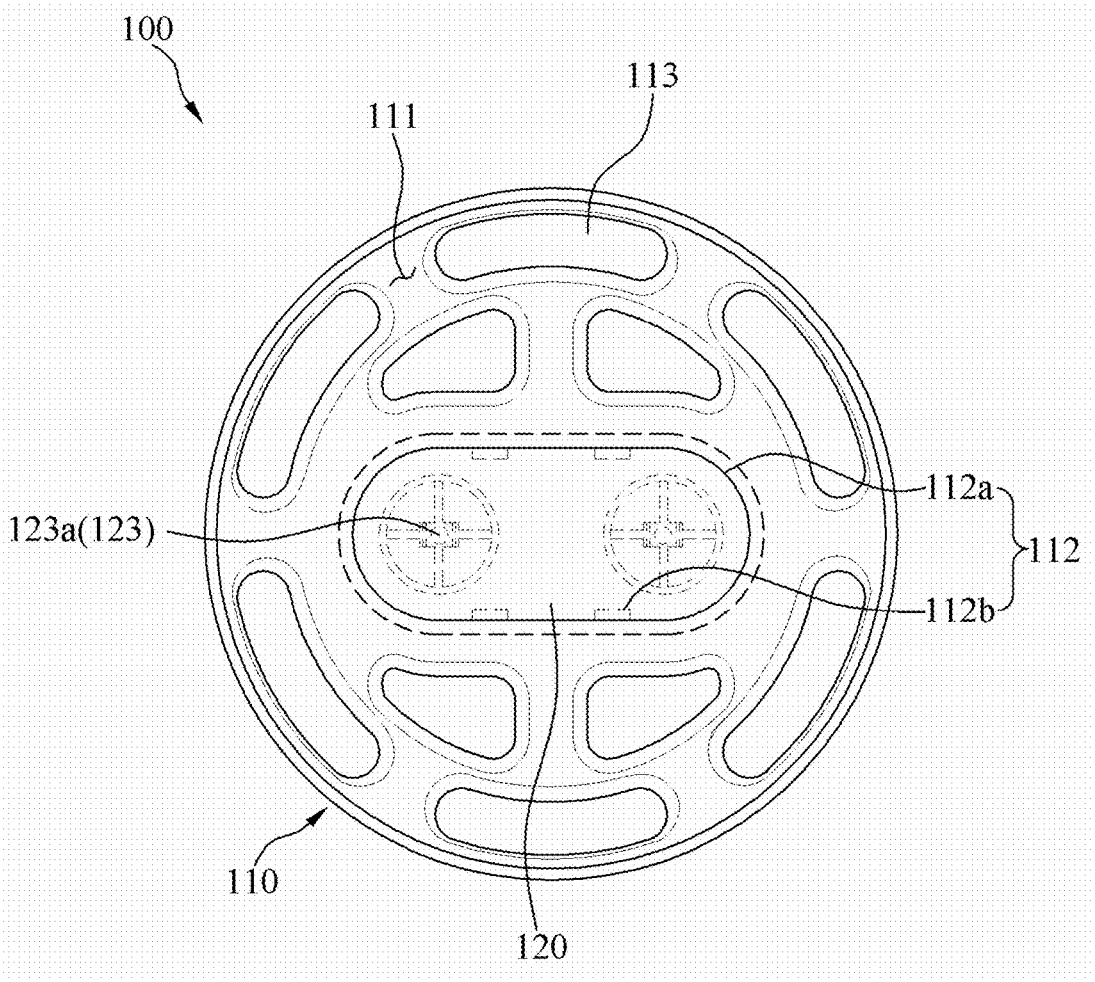

[Fig. 3]
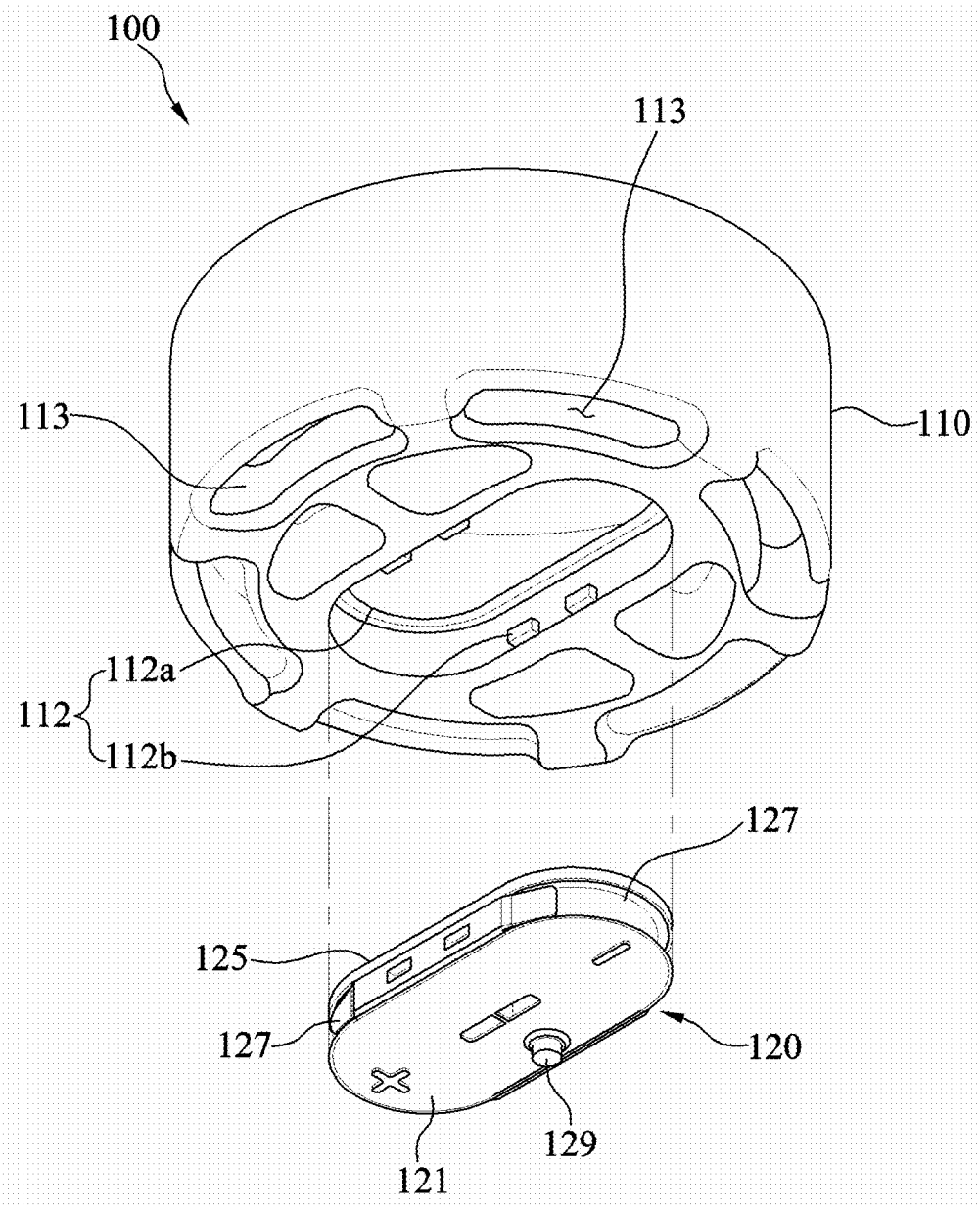

[Fig. 4]
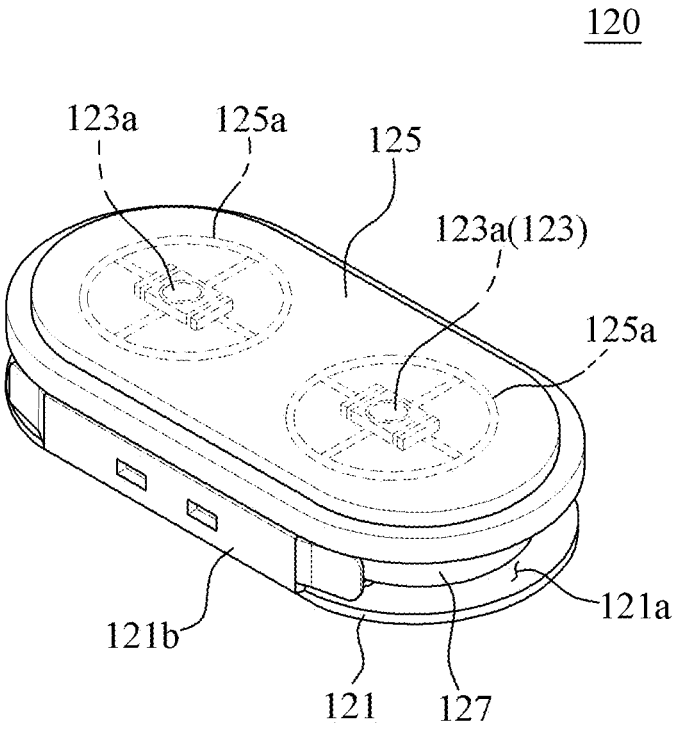

[Fig. 5]
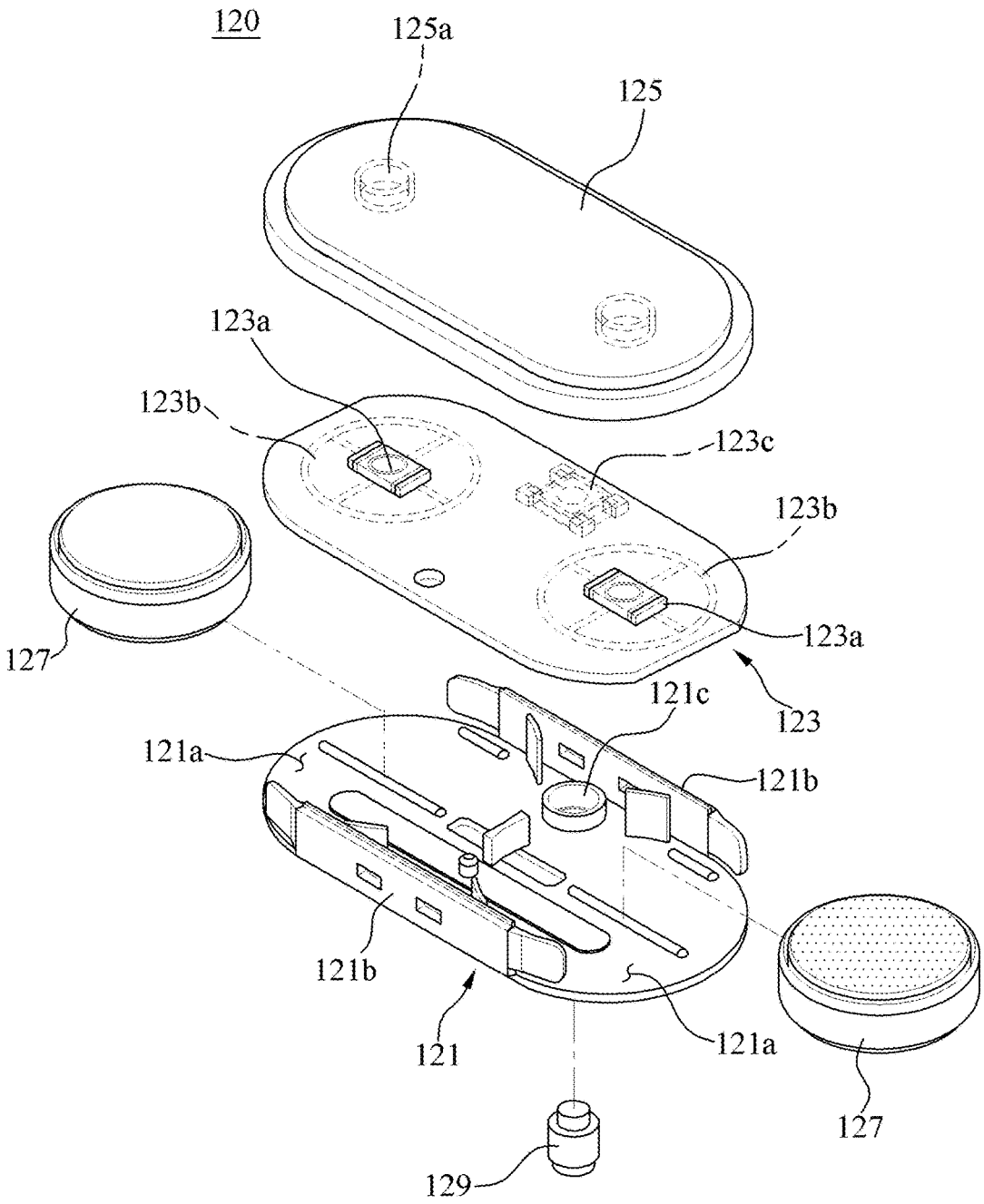

[Fig. 6]
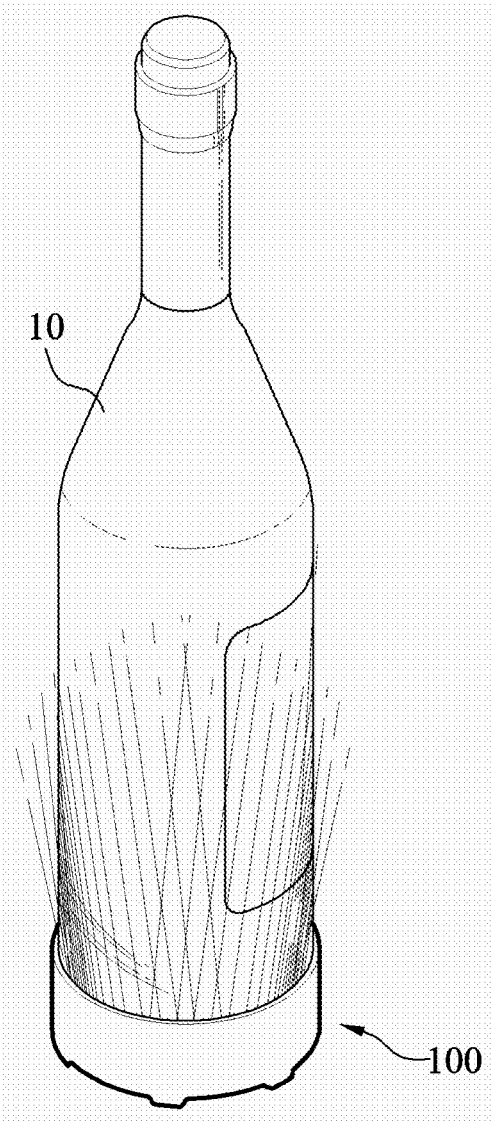

BOTTLE HOLDING APPARATUS HAVING REMOVABLE LED LIGHT SOURCE

CROSS-REFERENCE TO RELATED APPLICATIONS

This application is a continuation of Application No. PCT/KR2015/008113, filed Aug. 3, 2015 which in turn claims the benefit of Korean Patent Application No. 10-2015-0040377, filed Mar. 23, 2015, the disclosures of which are incorporated by reference into the present application.

TECHNICAL FIELD

The present invention relates to a bottle holding apparatus having a removable LED light source. More particularly, the present invention relates to a bottle holding apparatus having a removable LED light source, the apparatus holding a bottle such that light generated by an LED light source thereof is illuminated through a lower portion of the bottle, whereby the apparatus can provide visual lighting effects and create a romantic atmosphere suitable for drinking alcohol.

BACKGROUND ART

Most people who enjoy non-nutritive foods, such as alcohol, which are consumed for distinctive taste or smell thereof care about the atmosphere, mood, or ambience of a drinking place as much as the taste of alcohol. Among people who care about the atmosphere of a drinking place, some may want to drink in an unusual atmosphere. For example, some people may want to drink with lighting that illuminates only them in a dimly lit environment.

For this reason, most drinking places such as cafes or bars that sell alcohol have an interior in which the main lighting is intentionally dimmed and each table is provided with auxiliary lighting which illuminates only the table with dim light. Alternatively, the overall space is partitioned into a plurality of sections, and a lamp with a translucent shade is installed on the wall or the ceiling of each partitioned section to illuminate the section with dim light, thereby providing a comfortable atmosphere. However, it is difficult to satisfy all customers who have different preferences for an atmosphere or ambience.

In the case of creating a specific atmosphere by changing the interior, large costs are incurred. Therefore, such a method is economically burdensome. Further, the method is also likely to cause electric accidents due to complicated electric wiring.

The applicant of the present application intends to provide a method of creating lighting effects to provide a romantic atmosphere suitable for drinking alcohol without changing the whole interior.

DISCLOSURE

Technical Problem

Accordingly, the present invention has been made keeping in mind the above problems occurring in the related art, and an objective of the present invention is to provide a bottle holding apparatus having a removable LED light source, the apparatus including a bottle holder body and a lighting device module that is removably fitted into and easily removed from the bottom of the bottle holder body configured to accommodate a lower portion of a bottle because the lighting device module is provided as a module type, so that light generated by an LED light source of the lighting device module is illuminated through the lower portion of the bottle, whereby the apparatus provides visual lighting effects and creates a romantic atmosphere suitable for drinking alcohol.

Another objective of the present invention is to provide a bottle holding apparatus having a removable LED light source in which: a bottle support portion of a bottle holder body is provided with a plurality of water discharge holes arranged along the outer periphery thereof, thereby effectively protecting a lighting device module from water resulting from condensation flowing down along the surface of a bottle; and the lighting device module is removably fitted in the bottle holder body, thereby facilitating cleaning and maintenance of the bottle holder body.

A further objective of the present invention is to provide a bottle holding apparatus having a removable LED light source, in which: a plurality of bottle holder bodies having different sizes is prepared to accommodate bottles of various sizes; and lighting device module installation portions respectively provided in the bottle holder bodies have an equal size corresponding to the size of the lighting device module because the lighting device module has a standard size, whereby the lighting device modules can be applied to any size bottle holder body so that the apparatus can be conveniently used to hold bottles of various sizes at low costs.

Technical Solution

In order to accomplish the objectives of the present invention, there is provided a bottle holding apparatus having a removable LED light source, the bottle holding apparatus including;

a bottle holder body having a cylinder shape with an open upper end through which a lower portion of a bottle is inserted to be accommodated in the bottle holder body, the bottle holder body including a bottle support portion supporting the bottle rested thereon and a lighting device module installation portion that is an oblong through-hole formed at a center portion of the bottle support portion; and a lighting device module having a module form and an oblong shape corresponding to the shape of the lighting device module installation portion of the bottle holder body, being removably fitted in the lighting device module installation portion, and emitting light generated by an LED light source thereof to the bottle accommodated in the bottle holder body, thereby creating a desired atmosphere with the light.

Preferably, the bottle holder body may further include a plurality of water discharge holes arranged along the outer periphery of the bottle support portion to prevent water resulting from condensation flowing down along the surface of the bottle mounted on the bottle support portion from coming into contact with the lighting device module, thereby protecting the lighting device module from the water.

Preferably, the lighting device module installation portion may include an oblong flange provided at an upper end thereof and a plurality of engagement protrusions provided at a lower end thereof, the protrusions being arranged to face each other and disposed at middle portions of longer sides of the lighting device module installation portion such that the lighting device module is removably fitted into the lighting device module installation portion and is removable from underside of the bottle holder body.

More preferably, the bottle holder body may include a plurality of bottle holder bodies of various sizes to accommodate bottles of various sizes, in which the lighting device module installation portions of the bottle holder bodies have an equal size corresponding to the size of the lighting device module that has an oblong shape and a standard size.

More preferably, the lighting device module may include: a lower case having an oblong shape, being open at two opposite sides thereof to provide battery insertion portions through which two coin-cell batteries are inserted, and having a switch hole disposed close to either one of two side walls opposite to each other;

an oblong PCB circuit unit having an oblong shape, being installed in the lower case, and including a pair of LED chips provided on one surface thereof, a pair of electrode patterns provided on a lower surface thereof, and a tact switch disposed at a position corresponding to the switch hole and used to switch on and off the LED chips;

an upper case having a shape corresponding to the shape of the lower case, thereby being configured to cover an upper end of the lower case mounted with the oblong PCB circuit unit; and the two coin-cell batteries inserted through the battery insertion portions into the lower case in a state in which the lower case mounted with the oblong PCB circuit unit and the upper case are assembled with each other, thereby being electrically connected to the electrode patterns of the PCB circuit unit to supply power for operating the LED chips.

Further preferably, the upper case may be made of a transparent material and provided with a pair of light diffusion prevention protrusions on an inside surface thereof at positions corresponding to the pair of LED chips to prevent diffusion of light generated by the LED chips.

Yet further preferably, the lighting device module may further include a knob manipulation portion that is externally manipulated to switch on and off the tact switch of the oblong PCB circuit unit, the tact switch being located at a position corresponding to the switch hole of the lower case.

Advantageous Effects

According to the bottle holding apparatus having a removable LED light source, provided by the present invention, the bottle holding apparatus is composed of a bottle holder body and a lighting device module, in which the lighting device module can be readily attached to and detached from the bottle holder body structured to accommodate a lower portion of a bottle, wherein the lighting device module can be fitted from underside of the bottle holder body when it is attached to the bottle holder body. Since light generated by an LED light source of the lighting device module illuminates through a lower portion of a bottle accommodated in the bottle holder body, the bottle holding apparatus can provide visual lighting effects and create a romantic atmosphere suitable for drinking alcohol.

In addition, according to the present invention, since a bottle support portion of the bottle holder body is provided with a plurality of water discharge holes arranged along the outer periphery of the bottle support portion, it is possible to effectively protect a lighting device module from water resulting from condensation flowing down along the surface of a bottle. In addition, since the lighting device module can be easily attached to and detached from the bottle holder body, cleaning and maintenance of the bottle holder body can be easily performed.

In addition, according to the present invention, multiple bottle holder bodies with different sizes are prepared to hold bottles of various sizes. However, the lighting device module installation portions provided in the respective bottle holder bodies have an equal size because the lighting device modules are provided in a standard size. Since the lighting device modules having the standard size can be applied to any size bottle holder bodies, the bottle holding apparatus according to the present invention can be conveniently used for various sizes of bottles at low costs.

DESCRIPTION OF DRAWINGS

FIG. 1 is a perspective view of a bottle holding apparatus having a removable LED light source, according to one embodiment of the present invention;

FIG. 2 is a plan view illustrating the bottle holding apparatus having a removable LED light source, according to the embodiment of the present invention;

FIG. 3 is an exploded perspective view illustrating the bottle holding apparatus having a removable LED light source, according to the embodiment of the present invention;

FIG. 4 is a perspective view illustrating a lighting device module applied to the bottle holding apparatus having a removable LED light source, according to the embodiment of the present invention;

FIG. 5 is an exploded perspective view illustrating the lighting device module applied to the bottle holding apparatus having a removable LED light source, according to the embodiment of the present invention; and FIG. 6 is a diagram describing installation and application states of the bottle holding apparatus having a removable LED light source, according to the embodiment of the present invention.

DESCRIPTION OF THE REFERENCE NUMERALS IN THE DRAWINGS

100: bottle holding apparatus according to one embodiment of the present invention
110: bottle holder body 111: bottle support portion
112: lighting device module installation portion 112*a*: flange
112*b*: engagement protrusion 113: water discharge hole
120: lighting device module 121: lower case
121*a*: battery insertion portion 121*b*: sidewall
121*c*: switch hole 123: oblong PCB circuit unit
123*a*: LED chip 123*b*: electrode pattern
123*c*: tact switch 125: upper case
125*a*: light diffusion prevention protrusion 127: coin cell battery
129: knob manipulation portion

BEST MODE

Hereinafter, a preferred embodiment of the present invention will be described in detail with reference to the accompanying drawings to help those skilled in the art easily implement the present invention. In the following description of the preferred embodiment of the present invention, descriptions of known functions and configurations which are deemed to make the gist of the present invention unnecessarily obscure will be omitted below. The same reference numerals throughout the drawings denote elements having the same or similar function.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between", "directly between", "adjacent to", or "directly adjacent to" should be construed in the same way.

FIG. 1 is a perspective view of a bottle holding apparatus having a removable LED light source, according to one embodiment of the present invention; FIG. 2 is a plan view illustrating the bottle holding apparatus having a removable LED light source, according to the embodiment of the present invention; and FIG. 3 is an exploded perspective view illustrating the bottle holding apparatus having a removable LED light source, according to the embodiment of the present invention. As illustrated in FIGS. 1 to 3, according to one embodiment, a bottle holding apparatus 100 having a removable LED light source includes a bottle holder body 110 and a lighting device module 120.

The bottle holder body 110 has a cylinder shape with an open upper end through which a lower portion of a bottle 10 (see FIG. 6) can be inserted to be fixedly accommodated in the cylinder-shaped bottle holder body. The bottle holder body 110 includes a bottle support portion 111 to support the bottle 10 rested thereon. A center portion of the bottle support portion 111 is provided with an oblong through-hole serving as a lighting device module installation portion 112. The lighting device module installation portion 112 may be provided with a plurality of water discharge holes 113 arranged along the outer periphery thereof. Since water resulting from condensation flowing down along the surface of the bottle 10 rested on the bottle support portion 111 can be discharged out of the bottle holder body through the water discharge holes 113 without coming into contact with the lighting device module 120, the lighting device module 120 can be protected from the water. As illustrated in FIG. 3, the lighting device module installation portion 112 may be provided with an oblong flange 112*a* at an upper end thereof and a plurality of engagement protrusions 112*b* at a lower end thereof such that the lighting device module 120 can be removably fitted into the lighting device module installation portion 112 from underside of the bottle holder body 110. That is, the lighting device module 120 is installable and removable from underside of the bottle holder body 110. The engagement protrusions 112*b* are arranged to face each other at middle portions of longer sides of the lighting device module installation portion 112. The plurality of engagement protrusions 112 may be a pair of engagement protrusions 112*b* arranged to face each other, and may be made of a soft material to prevent the lighting device module 120 from being damaged when the lighting device module 120 is fitted into the bottle holder body.

As to the bottle holder body 110, a plurality of bottle holder bodies 110 having different sizes is prepared to accommodate bottles 10 of various sizes. However, the lighting device module installation portions 112 of the respective bottle holder bodies 110 preferably have an equal size corresponding to the size of the lighting device module 120 because the lighting device modules 120 are provided in a standard size. That is, the bottle holder bodies 110 are provided in various sizes to accommodate the bottles 10 of various sizes, whereas the lighting device module installation portions 112 of the respective bottle holder bodies 110 are provided in an equal size corresponding to the size of the lighting device modules 120 all of which are provided in the same standard size. In conclusion, since the lighting device module 120 can be applied to all sizes of bottle holder bodies 110, it can be conveniently used. For this reason, manufacturers can reduce manufacturing costs for the bottle holding apparatuses 100 used for bottles 10 of various sizes, and thus users can purchase the bottle holding apparatus 10 at low prices. Preferably, the bottle holder body 110 is made of silicone, plastic, or metal. More preferably, the bottle holder body 110 may be made of silicone. The bottle holder body 110 is preferably made of a transparent material, but not limited thereto. The bottle holder bodies 100 may be provided in various colors.

The lighting device module 120 is provided as a module type and has an oblong shape corresponding to the shape of the lighting device module installation portion 112 formed in the bottle holder body 110. The lighting device module 120 is removably fitted in the lighting device module installation portion 112, thereby being easily removed from the bottle holder body 110. The lighting device module 120 emits light generated by an LED light source thereof to the bottle 10 accommodated in the bottle holder body 110, thereby creating a desired atmosphere. The lighting device module 120 is structured to be removably fitted into the lighting device module installation portion 112 provided at the center portion of the bottle support portion 111 of the bottle holder body 110. In addition, the lighting device module 120 is structured to emit light generated by the LED light source thereof to the bottle 10 accommodated in the bottle holder body 110. The detailed structure of the lighting device module 120 will be described below with reference to FIGS. 4 and 5.

FIG. 4 is a perspective view illustrating the lighting device module applied to the bottle holding apparatus having a removable LED light source, according to the embodiment of the invention, and FIG. 5 is an exploded perspective view illustrating the lighting device module applied to the bottle holding apparatus having a removable LED light source, according to the embodiment of the invention. As illustrated in FIGS. 4 and 5, the lighting device module 120 according to the present invention may include a lower case 121, an oblong PCB circuit unit 123, an upper case 125, and two coil cell batteries 127. The lighting device module 120 may further include a knob manipulation portion 129.

The lower case 121 has an oblong shape and is open at two opposite sides to provide respective battery insertion portions 121*a* through which the two coin-cell batteries 127 are inserted into the lower case 121. The lower case 121 includes two opposite side walls 121*b* at other two sides thereof, respectively. The lower case 121 further includes a switch hole 121*c* disposed close to one of the side walls 121*b*. As illustrated in FIG. 5, one surface of the lower case 121 is provided with a plurality of protrusions (not shown), fixing members (not shown) for fixing the coin cell batteries 127, and a barrier wall (not shown) to space the two coin cell batteries 127 from each other. The oblong PCB circuit unit 123 has an oblong shape and is installed in the lower case 121. A pair of LED chips 123*a* are mounted on an upper surface of the oblong PCB circuit unit 123, a pair of electrode patterns 123*b* are provided on a lower surface of the oblong PCB circuit unit 124, and a tact switch 123*c* for switching on and off the LED chips 123*a* is provided at a position corresponding to the switch hole 121*c* and on the lower surface of the oblong PCB circuit unit 123. The oblong PCB circuit unit 123 is constructed such that the LED chips 123*a* are turned on and off in accordance with switching operation of the tact switch 123*c*. Alternatively, the LED chips 123*a* can be operated to flash on and off. The upper case 125 has a shape corresponding to the overall shape of the lower case 121, thereby covering an upper end of the lower case 121 mounted with the oblong PCB circuit unit 123. That is, the upper case 125 has an oblong plate shape and is combined with the lower case 121. The upper case 125 is made of a transparent material, and an inside surface (i.e. lower surface) of the upper case 125 is provided with a pair of light diffusion prevention protrusions 125*a* at positions corresponding to the LED chips 123*a* of the oblong PCB circuit unit 123 to prevent light generated by the LED chips 123*a* from being diffused. The two coin-cell batteries 127 are circular plate-shaped mercury cells.

The two coin-cell batteries 127 are inserted into the lower case 121 through the battery insertion portions 121*c* of the lower case 121 after the lower case 121 mounted with the oblong PCB circuit unit 123 is combined with the upper case 125. The inserted coin cell batteries 127 are electrically connected to the electrode patterns 123*b* of the oblong PCB circuit unit 123, thereby supplying power for operating the LED chips. The knob manipulation portion 129 is an element connected to the tact switch 123*c* of the PCB circuit unit 123, which is disposed corresponding to the switch hole 121*c* of the lower case 121, so that the tact switch 123*c* can be externally switched on and off in accordance with manipulation of the knob manipulation portion 129.

FIG. 6 is a diagram describing installation and application states of the bottle holding apparatus having a removable LED light source, according to the embodiment of the present invention. With reference to FIG. 6, a lower portion of a bottle 10 is received in the bottle holder body 110 mounted with the lighting device module 120, and the LED chips 123 of the lighting device module 120 emit light to illuminate the lower portion of the bottle 10. Thus, thus visual lighting effects are provided through the lower portion of the bottle 10.

As described above, the bottle holding apparatus having a removable LED light source, according to one embodiment of the present invention, provides visual lighting effects and creates a romantic atmosphere suitable for drinking alcohol by illuminating a lower portion of a bottle with light emitted by the LED light source. In addition, the lighting device module of a module type can be removably fitted into the bottle holder body from underside and can be easily removed from the bottle holder body from underside. In addition, the water discharge holes arranged along the outer periphery of the bottle support portion of the bottle holder body prevent the lighting device module from being coming into contact with water resulting from condensation flowing down along the surface of the bottle, thereby effectively protecting the lighting device from the water. In addition, since the lighting device module can be easily attached to and detached from the bottle holder body, cleaning and maintenance of the bottle holder body can be easily performed. In addition, since the lighting device module provided in a standard size can be combined with an any size bottle holder body, manufactures and users can save costs for preparing and obtaining the bottle holding apparatus.

The present invention described above can be variously changed, altered, modified, or applied by those skilled in the art, and the technical scope of the present invention should be defined by the following claims.

The invention claimed is:

1. A bottle holding apparatus having a removable LED light source, the bottle holding apparatus (100) comprising:

a bottle holder body (110) having a cylinder shape with an open upper end through which a lower portion of a bottle (10) is inserted to be accommodated in the bottle holder body (110), the bottle holder body (110) including a bottle support portion (111) supporting the bottle (10) rested thereon and a lighting device module installation portion (112) that is formed as an oblong through-hole and disposed at a center portion of the bottle support portion (111); and a lighting device module (120) having a module form and an oblong shape corresponding to a shape of the lighting device module installation portion (112) of the bottle holder body (110), being removably fitted in the lighting device module installation portion (112), and illuminating the bottle (10) accommodated in the bottle holder body (110) with light generated by an LED light source thereof, thereby creating a desired atmosphere, wherein the lighting device module installation portion (112) includes an oblong flange (112*a*) at an upper end thereof and a pair of engagement protrusions at a lower end thereof, the protrusions being arranged to face each other at middle portions of longer sides of the lighting device module installation portion (112) such that the lighting device module (120) is removably fitted into the lighting device module installation portion (112) and is removable, from underside of the bottle holder body (110) wherein the lighting device module comprises batteries, switch, light emitting diodes, and electrode patterns, and wherein the bottle holder body is further provided with a plurality of water discharge holes arranged along an outer periphery of the bottle support portion surrounding the lighting device module installation portion to prevent water resulting from condensation flowing down along the surface of the bottle rested on the bottle support portion from coming into contact with the lighting device module, thereby protecting the lighting device from the water.

2. The bottle holding apparatus according to claim 1, wherein the bottle holder body (110) comprises a plurality of bottle holder bodies (110) of various sizes to accommodate bottles (10) of various sizes, wherein the bottle holder bodies (110) are provided with respective lighting device module installation portions (112) having an equal size corresponding to that of the lighting device module (120) having a module form and provided in a standard size.

3. The bottle holding apparatus according to claim 1, wherein the lighting device module (120) further comprises a pair of grooves disposed at positions corresponding to the pair of engagement protrusions such that the lighting device module (120) is capable of fitting into the lighting device module installation portion (112).

4. The bottle holding apparatus according to claim 2, wherein the lighting device module (120) comprises:

a lower case (121) having an oblong shape, being open at two opposite sides thereof to provide battery insertion portions (121*a*) through which two coin-cell batteries (127) are respectively inserted into the lower case (121), and having a switch hole (121*c*) disposed close to either one of two opposite side walls (121);

a PCB circuit unit (123) having an oblong shape, being installed in the lower case (121), and comprising a pair of LED chips (123*a*) installed on one surface thereof, a pair of electrode patterns (123*b*) provided on a lower surface thereof, and a tact switch (123*c*) disposed at a position corresponding to the switch hole (121*c*) and used to switch on and off the LED chips (123*a*);

an upper case (125) having a shape corresponding to that of the lower case (121), thereby covering an upper end of the lower case (121) mounted with the oblong PCB circuit unit (123); and the two coin-cell batteries (127) inserted into the lower case respectively through the battery insertion portions (121*c*) in a state in which the lower case (121) mounted with the oblong PCB circuit unit (123) and the upper case (121) are assembled with each other, the two coin-cell batteries (127) being respectively electrically connected to the electrode patterns (123*b*) of the oblong PCB circuit unit (123) to supply power for operating the LED chips.

5. The bottle holding apparatus according to claim 4, wherein the upper case (125) is made of a transparent material and provided with a pair of light diffusion prevention protrusions on an inner surface thereof, at positions corresponding to the pair of LED chips (123*a*) of the oblong PCB circuit unit (123), thereby preventing diffusion of light emitted by the LED chips (123*a*).

6. The bottle holding apparatus according to claim 4, wherein the lighting device module (120) further comprises a knob manipulation portion (129) connected to the tack switch (123*c*) of the oblong PCB circuit unit (123), which is disposed to correspond to the switch hole (121*c*) of the lower case (121), such that the tact switch (123*c*) is externally switched on and off in accordance with manipulation of the knob manipulation portion (129).

* * * * *